US005201375A

United States Patent [19]

Base et al.

[11] Patent Number: 5,201,375

[45] Date of Patent: Apr. 13, 1993

[54] DOWNHOLE DRILLING TOOL SYSTEM

[75] Inventors: James D. Base, Ormsby St. Margaret; David Harvey, Great Yarmouth, both of England

[73] Assignee: Fontan Limited, Douglas, Isle of Man

[21] Appl. No.: 503,615

[22] Filed: Apr. 2, 1990

[51] Int. Cl.[5] ..... E21B 7/06

[52] U.S. Cl. ..... 175/45; 175/48; 175/61; 175/73

[58] Field of Search ..... 175/73, 76, 61, 267, 175/325, 27, 38, 45; 73/151

[56] References Cited

U.S. PATENT DOCUMENTS

| | | | |
|---|---|---|---|
| 3,370,657 | 2/1968 | Antle | 175/73 X |
| 3,974,886 | 8/1976 | Blake, Jr. | 175/76 |
| 4,270,619 | 6/1981 | Base | 175/61 |
| 4,324,297 | 4/1982 | Denison | 175/45 |
| 4,416,339 | 11/1983 | Baker et al. | 175/61 |
| 4,471,843 | 9/1984 | Jones, Jr. et al. | 175/73 |
| 4,592,432 | 6/1986 | Williams et al. | 175/61 X |

*Primary Examiner*—William P. Neuder
*Attorney, Agent, or Firm*—Neal J. Mosely

[57] ABSTRACT

In one broad aspect, the invention provides a method of receiving instructions for an implement, for example, a drill string stabilizer, mounted on a drill string, which instructions are transmitted by varying the rate of flow of, or pressure exerted by, the fluid in the bore of the drill string in accordance with one of a plurality of predetermined sequences; the method comprising the steps of:

a) monitoring variations in the rate of flow of, or pressure exerted by, the fluid in the drill string;

b) comparing the sequence of monitored variations with a plurality of predetermined sequences, each predetermined sequence corresponding to a set of instructions for the implement; and c) either i) ignoring the variations if they do not correspond to a predetermined sequence, or ii) if the variations do correspond to a predetermined sequence, executing the instructions which correspond to that sequence.

In another broad aspect, the invention provides a drill string stabilizer comprising a mandrel, slidably mounted within an outer casing; one or more pads movable between a retracted position and one or more extended positions; means monitoring the rate of flow of, or pressure exerted by, the fluid in the drill string in use; and means which, when activated, seal the stabilizer to restrict or prevent the flow of fluid through it; the arrangement being such that, with the sealing means activated, the exertion of a predetermined amount of pressure by the fluid causes the mandrel to slide within the casing, and the pad or pads to consequently extend.

20 Claims, 23 Drawing Sheets

FLAPPER ACTIVE
N
Y
TIME OUT
N
Y
FLAPPER ACTIVE
Y
SHUTDOWN
N
DEC COUNT
COUNT Ø
N
Y
LOAD COUNT W/4
START TIMER
TIME OUT
N
Y
FLAPPER ACTIVE
Y
SHUTDOWN
N
START COUNT
TIME OUT
N
Y
READ FLAPPER STATUS
* GENERATE A 1 ON ACTIVE ELSE Ø

FIG. 20A

```
1                   ;***  STABILIZER COMMS V3.****
2                   ;** WITH VARIFICATION ********
3                   ;*** AND SHUTDOWN AT DATA ****
4                   ;***                 ********
5                   ;***                        *
6                   ;*                       ****
7                   ;***               ************
8                   ;*******************************
9                   PORTA1:       EQU  0
10                  PORTB1:       EQU  1
11                  PORTA2:       EQU  2
12                  PORTB2:       EQU  3
13                                ORG  0
14                                LOAD 8000H
15  0000 3EFF                     LD   A,255
16  0002 3D         SLOOP:        DEC  A
17  0003 20FD                     JR   NZ,SLOOP
18  0005 110000                   LD   DE,0
19  0008 310020                   LD   SP,2000H
20  000B 0E02                     LD   C,PORTA2
21  000D 3E00                     LD   A,0
22  000F ED79                     OUT  (C),A
23  0011 3EFF                     LD   A,255
24  0013 ED79                     OUT  (C),A
25  0015 3E3F                     LD   A,3FH
26  0017 ED79                     OUT  (C),A
27  0019 3E07                     LD   A,07
28  001B ED79                     OUT  (C),A
29  001D 3E80                     LD   A,80H
30  001F D300                     OUT  (PORTA1),A
31  0021 0E03                     LD   C,PORTB2
32  0023 3E00                     LD   A,0
33  0025 ED79                     OUT  (C),A
34  0027 3EFF                     LD   A,255
35  0029 ED79                     OUT  (C),A
36  002B 3E07                     LD   A,07
37  002D ED79                     OUT  (C),A
38  002F ED79                     OUT  (C),A
39  0031 0E01                     LD   C,PORTB1
40  0033 3EFF                     LD   A,255
41  0035 ED79                     OUT  (C),A
42  0037 ED78       CLPLS:        IN   A,(C)
43  0039 CB57                     BIT  2,A
44  003B 20FA                     JR   NZ,CLPLS
45  003D 3E00                     LD   A,0
46  003F D300                     OUT  (PORTA1),A
47                  ;**** SYSTEM READY ********
48  0041 ED78       START:        IN   A,(C)
49  0043 CB47                     BIT  0,A
50  0045 20FA                     JR   NZ,START
51  0047 ED78                     IN   A,(C)
52  0049 E6F7                     AND  0F7H
53  004B ED79                     OUT  (C),A
54  004D F608                     OR   8
55  004F ED79                     OUT  (C),A
56  0051 ED78       CLOCK1:       IN   A,(C)
57  0053 CB57                     BIT  2,A
58  0055 20FA                     JR   NZ,CLOCK1
59  0057 ED78                     IN   A,(C)
60  0059 CB47                     BIT  0,A
```

FIG. 20B

```
61  005B CAD501                    JP   Z,SHUTDOWN
62                   ;*** STAGE TWO *************
63  005E 0603                      LD   B,3
64  0060 ED78        STG2:         IN   A,(C)
65  0062 E6F7                      AND  0F7H
66  0064 ED79                      OUT  (C),A
67  0066 F608                      OR   8
68  0068 ED79                      OUT  (C),A
69  006A ED78        TRIG1:        IN   A,(C)
70  006C CB47                      BIT  0,A
71  006E CAD501                    JP   Z,SHUTDOWN
72  0071 ED78                      IN   A,(C)
73  0073 CB57                      BIT  2,A
74  0075 20F3                      JR   NZ,TRIG1
75  0077 ED78                      IN   A,(C)
76  0079 E6F7                      AND  0F7H
77  007B ED79                      OUT  (C),A
78  007D F608                      OR   8
79  007F ED79                      OUT  (C),A
80  0081 ED78        STG22:        IN   A,(C)
81  0083 CB57                      BIT  2,A
82  0085 CAD501                    JP   Z,SHUTDOWN
83  0088 ED78                      IN   A,(C)
84  008A CB47                      BIT  0,A
85  008C 20F3                      JR   NZ,STG22
86  008E ED78        CLPLS2:       IN   A,(C)
87  0090 CB57                      BIT  2,A
88  0092 20FA                      JR   NZ,CLPLS2
89  0094 ED78                      IN   A,(C)
90  0096 CB47                      BIT  0,A
91  0098 CAD501                    JP   Z,SHUTDOWN
92  009B 05                        DEC  B
93  009C C26000                    JP   NZ,STG2
94                   ;*** STAGE THREE **********
95  009F 0604                      LD   B,4
96  00A1 ED78        DATAIN:       IN   A,(C)
97  00A3 E6F7                      AND  0F7H
98  00A5 ED79                      OUT  (C),A
99  00A7 F608                      OR   8
100 00A9 ED79                      OUT  (C),A
101 00AB ED78        TOUT1:        IN   A,(C)
102 00AD CB57                      BIT  2,A
103 00AF 20FA                      JR   NZ,TOUT1
104 00B1 ED78                      IN   A,(C)
105 00B3 CB47                      BIT  0,A
106 00B5 CAD501                    JP   Z,SHUTDOWN
107 00B8 E6F7                      AND  0F7H
108 00BA ED79                      OUT  (C),A
109 00BC F608                      OR   8
110 00BE ED79                      OUT  (C),A
111 00C0 ED78        TOUT2:        IN   A,(C)
112 00C2 CB57                      BIT  2,A
113 00C4 20FA                      JR   NZ,TOUT2
114 00C6 ED78                      IN   A,(C)
115 00C8 E601                      AND  1
116 00CA 1F                        RRA
117 00CB 3F                        CCF
118 00CC CB12                      RL   D
119 00CE 05                        DEC  B
120 00CF 20D0                      JR   NZ,DATAIN
```

FIG. 20C

```
121 00D1 ED78                    IN   A,(C)
122 00D3 E6F7                    AND  0F7H
123 00D5 ED79                    OUT  (C),A
124 00D7 F608                    OR   8
125 00D9 ED79                    OUT  (C),A
126 00DB ED78      TOUT3:        IN   A,(C)
127 00DD CB57                    BIT  2,A
128 00DF 20FA                    JR   NZ,TOUT3
129 00E1 ED78                    IN   A,(C)
130 00E3 CB47                    BIT  0,A
131 00E5 CAD501                  JP   Z,SHUTDOWN
132 00E8 E6F7                    AND  0F7H
133 00EA ED79                    OUT  (C),A
134 00EC F608                    OR   8
135 00EE ED79                    OUT  (C),A
136 00F0 ED78      TOUT4:        IN   A,(C)
137 00F2 CB47                    BIT  0,A
138 00F4 CAD501                  JP   Z,SHUTDOWN
139 00F7 CB57                    BIT  2,A
140 00F9 20F5                    JR   NZ,TOUT4
141                ;*** STAGE FOUR **********
142 00FB 5A                      LD   E,D
143 00FC 7A                      LD   A,D
144 00FD E603                    AND  3
145 00FF 57                      LD   D,A
146 0100 CB3B                    SRL  E
147 0102 CB3B                    SRL  E
148 0104 3E00                    LD   A,0
149 0106 BB                      CP   E
150 0107 CA7801                  JP   Z,VARIFY
151 010A DB00                    IN   A,(PORTA1)
152 010C CB3F                    SRL  A
153 010E CB3F                    SRL  A
154 0110 CB3F                    SRL  A
155 0112 CB3F                    SRL  A
156 0114 E603                    AND  3
157 0116 BB                      CP   E
158 0117 C2D501                  JP   NZ,SHUTDOWN
159 011A 3EEF                    LD   A,0EFH
160 011C ED79                    OUT  (C),A
161 011E 7A                      LD   A,D
162
163 011F FE00                    CP   0
164 0121 2004                    JR   NZ,NEXT1
165 0123 16EF                    LD   D,0EFH
166 0125 1812                    JR   READY
167 0127 FE01      NEXT1:        CP   1
168 0129 2004                    JR   NZ,NEXT2
169 012B 166F                    LD   D,6FH
170 012D 180A                    JR   READY
171 012F FE02      NEXT2:        CP   2
172 0131 2004                    JR   NZ,NEXT3
173 0133 16AF                    LD   D,0AFH
174 0135 1802                    JR   READY
175 0137 16CF      NEXT3:        LD   D,0CFH
176 0139 060C      READY:        LD   B,12
177 013B ED78      MLOOP:        IN   A,(C)
178 013D E6F7                    AND  0F7H
179 013F ED79                    OUT  (C),A
180 0141 F608                    OR   8
```

FIG. 20D

```
181 0143 ED79                OUT  (C),A
182 0145 ED78     TOUT5:     IN   A,(C)
183 0147 CB57                BIT  2,A
184 0149 2826                JR   Z,DECRB
185 014B ED78                IN   A,(C)
186 014D CB4F                BIT  1,A
187 014F 20F4                JR   NZ,TOUT5
188 0151 7A                  LD   A,D
189 0152 ED51                OUT  (C),D
190 0154 ED78     WAIT:      IN   A,(C)
191 0156 CB57                BIT  2,A
192 0158 20FA                JR   NZ,WAIT
193 015A ED78     HOLD:      IN   A,(C)
194 015C E6F7                AND  0F7H
195 015E ED79                OUT  (C),A
196 0160 F608                OR   8
197 0162 ED79                OUT  (C),A
198 0164 ED78     HOLDLP:    IN   A,(C)
199 0166 CB57                BIT  2,A
200 0168 20FA                JR   NZ,HOLDLP
201 016A 3EEF                LD   A,0EFH
202 016C ED79                OUT  (C),A
203 016E C38C01              JP   VERIFY2
204 0171 05       DECRB:     DEC  8
205 0172 C23B01              JP   NZ,MLOOP
206 0175 C3BC01              JP   ERROR
207 0178 DB00     VERIFY:    IN   A,(PORTA1)
208 017A CB3F                SRL  A
209 017C CB3F                SRL  A
210 017E CB3F                SRL  A
211 0180 CB3F                SRL  A
212 0182 E603                AND  3
213 0184 BA                  CP   D
214 0185 C2D501              JP   NZ,SHUTDOWN
215 0188 3EEF                LD   A,0EFH
216 018A ED79                OUT  (C),A
217 018C DB00     VERIFY2:   IN   A,(PORTA1)
218 018E CB47                BIT  0,A
219 0190 280E                JR   Z,POS1
220 0192 CB4F                BIT  1,A
221 0194 2812                JR   Z,POS2
222 0196 CB57                BIT  2,A
223 0198 2816                JR   Z,POS3
224 019A CB5F                BIT  3,A
225 019C 281A                JR   Z,POS4
226 019E 181C                JR   ERROR
227 01A0 0601     POS1:      LD   B,1
228 01A2 3E6F                LD   A,6FH
229 01A4 ED79                OUT  (C),A
230 01A6 1816                JR   VWAIT
231 01A8 0602     POS2:      LD   B,2
232 01AA 3EAF                LD   A,0AFH
233 01AC ED79                OUT  (C),A
234 01AE 180E                JR   VWAIT
235 01B0 0603     POS3:      LD   B,3
236 01B2 3ECF                LD   A,0CFH
237 01B4 ED79                OUT  (C),A
238 01B6 1806                JR   VWAIT
239 01B8 0604     POS4:      LD   B,4
240 01BA 1802                JR   VWAIT
```

FIG. 20E

```
241 01BC 0605      ERROR:      LD    B,5
242 01BE ED78      VWAIT:      IN    A,(C)
243 01C0 E6F7                  AND   0F7H
244 01C2 ED79                  OUT   (C),A
245 01C4 F608                  OR    8
246 01C6 ED79                  OUT   (C),A
247 01C8 ED78      VCLK:       IN    A,(C)
248 01CA CB57                  BIT   2,A
249 01CC 20FA                  JR    NZ,VCLK
250 01CE 05                    DEC   B
251 01CF 20ED                  JR    NZ,VWAIT
252 01D1 3EFF                  LD    A,255
253 01D3 ED79                  OUT   (C),A
254 01D5 0E00      SHUTDOWN:   LD    C,PORTA1
255 01D7 3E80                  LD    A,80H
256 01D9 ED79                  OUT   (C),A
257 01DB 00        STOP:       NOP
258 01DC C3DB01                JP    STOP
259                            END
```

DOWNHOLE DRILLING TOOL SYSTEM

FIELD OF THE INVENTION

The invention relates to drilling implements, for example drill string stabilizers, and more particularly to activating and instructing such implements. Although the invention will be described in relation to a drill string stabilizer, it will be clear that the invention is applicable to other kinds of drilling implements.

REVIEW OF THE ART KNOWN TO THE APPLICANT

There are already known several kinds of drill string stabilizer comprising a mandrel, slidably mounted within an outer casing, and a set of pads, which can be extended from or retracted into the outer casing by sliding movement of the mandrel within the outer casing.

Once the stabilizer has been mounted on the drill string and lowered into the well bore, the stabilizer may be activated by extending the pads so that they bear against the well bore. Depending on where, in relation to the drill bit, the stabilizer is situated, this either directly alters the path of the drill bit or causes the weight of the drill string between the stabilizer and the drill bit to alter the course of the drill bit.

In this way, one or more stabilizers mounted on the drill string at one or more strategic points, may be used to control the deviation of the bore hole with respect to the vertical.

Examples of such stabilizers are shown in U.S. Pat. Nos. 4,270,619 (Base), 3,974,886 (Blake Jnr), 3,370,657 (Antle) and 3,123,162 (Rowley). The pads of the stabilizers shown in the two earlier specifications have only one extended position, whilst those shown in the other two specifications can be extended into more than one position.

Various methods are used to remotely actuate these stabilizers, and thus avoid the need to remove the drill string from the well bore every time the pads need to be extended or retracted. These methods involve the use of either a mechanical force exerted on the stabilizer by the drill string, or the pressure exerted by the drilling fluid flowing through the drill string.

Where the pads have more than one extended position, it is necessary to ensure that the pressure exerted by the drilling fluid, or the force exerted on the drilling string is having the required effect on the stabilizer. To that end, the stabilizer shown in the Base specification, U.S. Pat. No. 4,270,619, uses a mechanically pre-programmed actuating member.

Once the actuating member has been programmed to extend or retract the pads into their required position, it is lowered on a wire down the drill string until it bears against, and consequently seals, the mandrel of the stabilizer. Drilling fluid is then pumped down the drill string, causing the mandrel to slide along the stabilizer casing.

A pawl mounted on the mandrel co-operates with a rack mounted on the casing to maintain the position of the mandrel relative to the casing (and therefore the position of the pads) once the actuating member has been removed. The actuating member either advances the pawl along the rack to extend the pads into the required position, or disengages the pawl from the rack, causing the pads to retract once fluid pressure has been removed.

The disadvantages of this arrangement are twofold: Firstly, the drilling operation has to be suspended while the actuating member is being lowered down the drill string; secondly, the actuator can only be pre-programmed to perform one task on one stabilizer so that, if more than one stabilizer is to be actuated, the task must be repeated for each stabilizer.

Other proposals for drill string stabilizers have been made, but to the best of the applicant's knowledge, these fail to provide the reliability and accuracy which the present invention seeks to achieve.

SUMMARY OF THE INVENTION

In one broad aspect, the invention provides a method of receiving instructions for an implement, for example, a drill string stabilizer, mounted on a drill string, which instructions are transmitted by varying the rate of flow of, or pressure exerted by, the fluid in the bore of the drill string in accordance with one of a plurality of predetermined sequences; the method comprising the steps of:

a) monitoring variations in the rate of flow of, or pressure exerted by, the fluid in the drill string;
b) comparing the sequence of monitored variations with a plurality of predetermined sequences, each predetermined sequence corresponding to a set of instructions for the implement; and
c) either
   i) ignoring variations if they do not correspond to a predetermined sequence, or
   ii) if the variations do correspond to a predetermined sequence executing the instructions which correspond to that sequence.

The implement preferably includes a conduit through which drilling fluid may flow and means which, when activated, so seal the implement as to restrict or prevent the flow of drilling fluid through the implement. In this case, each set of instructions for the implement preferably includes the step of maintaining the sealing means in an activated condition for a period of time distinctive of those instructions.

This period of time can be measured by monitoring the pressure of the fluid in the drill string. In this way, the implement provides confirmation, or otherwise, that the required set of instructions have been executed.

In another broad aspect, the invention provides a drill string stabilizer comprising a mandrel, slidably mounted within an outer casing; one or more pads movable between a retracted position and one or more extended positions; means monitoring the rate of flow of, or pressure exerted by, the fluid in the drill string in use; and means which, when activated, seal the stabilizer to restrict or prevent the flow of fluid through it; the arrangement being such that, with the sealing means activated, the exertion of a predetermined amount of pressure by the fluid causes the mandrel to slide within the casing, and the pad or pads to consequently extend.

Preferably the stabilizer includes means maintaining the pad or pads in one of a plurality of extended positions; the maintaining means comprising a set of dogs; each of which is pivotally mounted on the mandrel or casing at a position corresponding to one of the extended pad positions; and each dog, in use, being extended in response to a selected instruction, to so engage a surface of the casing or mandrel as to prevent the sliding of the mandrel in at least one direction along the casing.

The stabilizer may be instructed by the method which also forms part of the invention.

In another broad aspect, the invention provides apparatus for receiving instructions for an implement, for example a drill string stabilizer, mounted on a drill string, which instructions are transmitted by varying the rate of flow of, or pressure exerted by, the fluid in the bore of the drill string in accordance with one of a plurality of predetermined sequences; the apparatus comprising:

a) means monitoring variations in the rate of flow of, or pressure exerted by, the fluid in the drill string; and
b) means comparing the monitored variations with a plurality of predetermined sequences, each predetermined sequence corresponding to a set of instructions for the implement; which comparing means either:
   i) ignores the monitored variations if they do not correspond to a predetermined sequence, or
   ii) if the variations do correspond to a predetermined sequence, execute the instructions which correspond to that sequence.

The monitoring means may include a paddle, pivotally mounted on the implement. The sealing means may comprise the paddle and a paddle stop, which is movable between a retracted and a protruding position; the sealing means being activated by moving the paddle stop into its protruding position.

The invention, when used in relation to a drill string stabilizer, provides a relatively simple, quick and efficient way of instructing one or more stabilizers on the drill string.

BRIEF DESCRIPTION OF THE DRAWINGS

The invention will now be described, by way of example only, and with reference to the accompanying drawings, in which.

Figure 1:
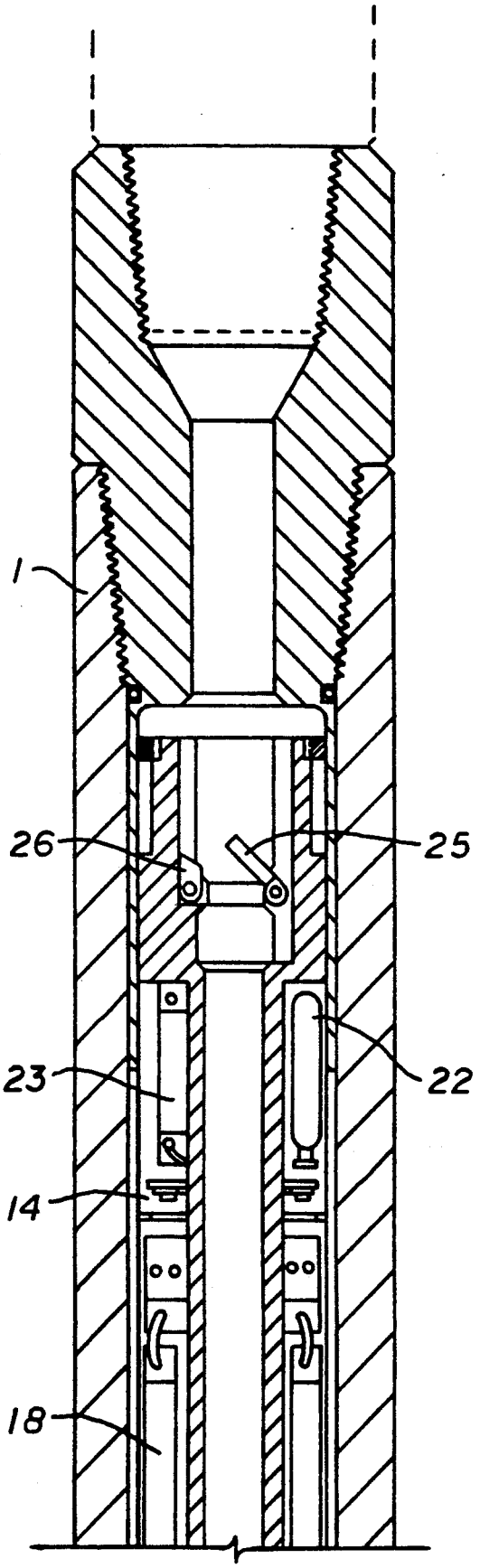
FIG. 1 is a sectional view of the upper part of a stabilizer embodying an aspect of the invention.
Figure 21:
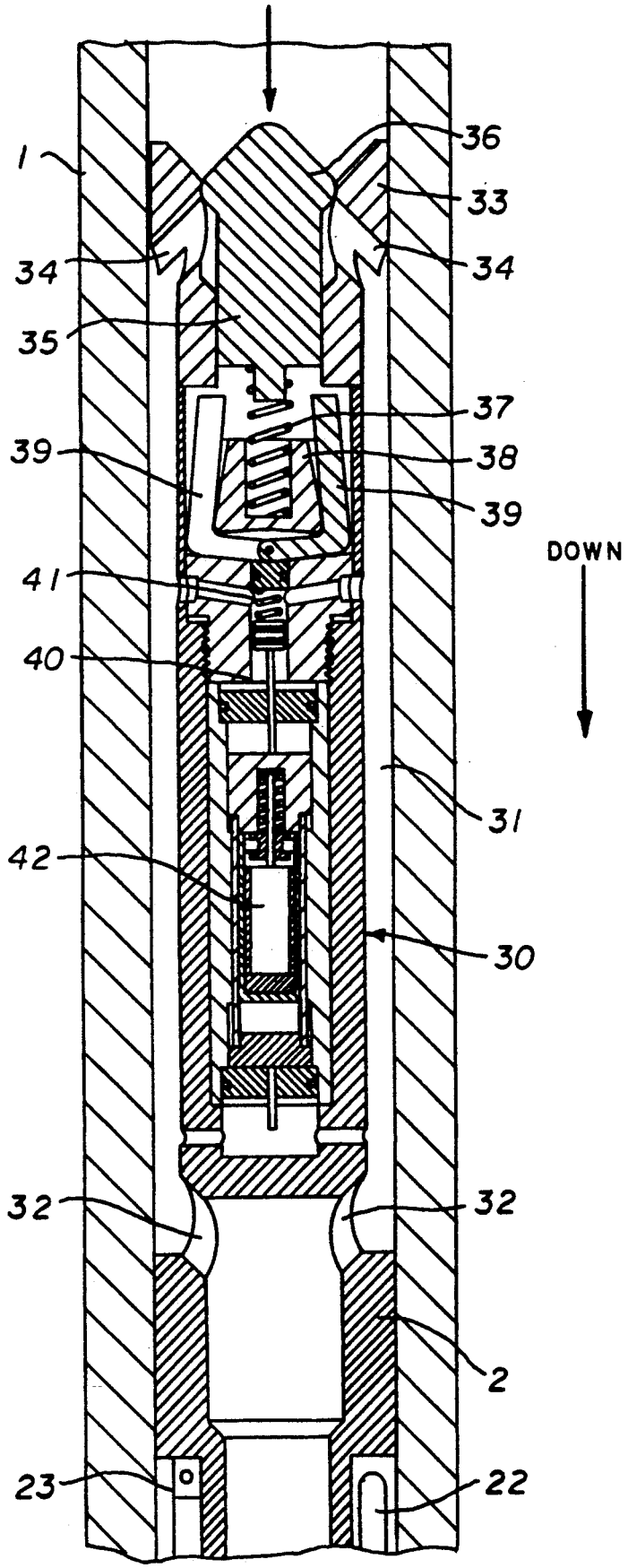

The listing of an example of the machine code program which may be used by the computer is scheduled to this specification, and are referenced FIGS. 20A-20E; with FIG. 21 an alternative to FIG. 1.

DESCRIPTION OF THE PREFERRED EMBODIMENT

Figure 2:
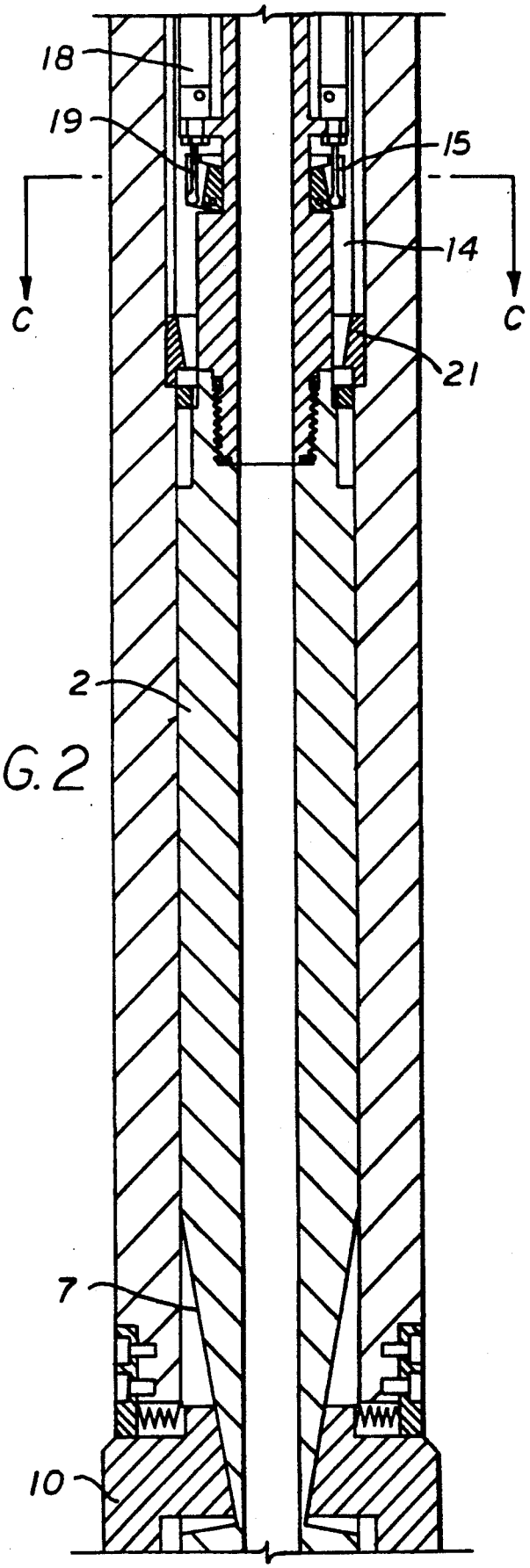
FIGS. 2 and 3 are sectional views respectively of the middle and lower portions of that stabilizer.
Figure 3:
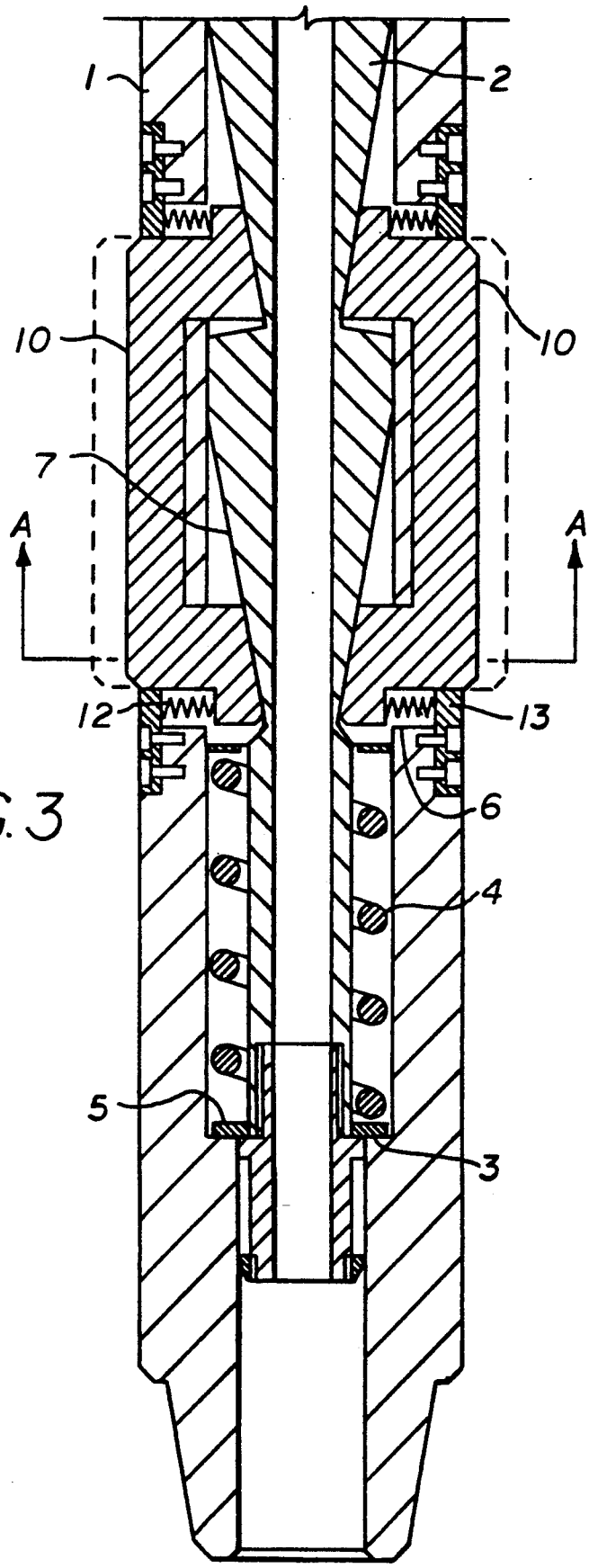

Referring to FIGS. 1, 2 and 3, a drill string stabilizer comprises an outer casing 1 having a central bore along its length, and in which a mandrel 2 is slidably mounted. The bore of the casing narrows in its lower region to form an upward facing shoulder 3, against which the bottom of a compression spring 4 bears via a spring retainer ring 5. The top of the compression spring 4 bears against a flange 6 on the mandrel 2, thus exerting an upward biasing force on the mandrel 2.

Figure 7:
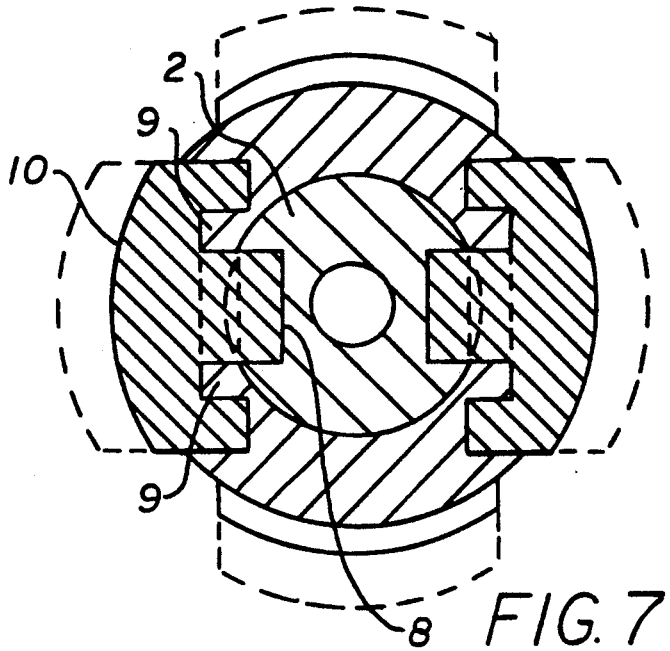
FIG. 7 is a sectional view along the line A—A of FIG. 3.

The outer surface of the mandrel 2 incorporates a number of tracks 7. Each track 7 comprises a central recess 8 (FIG. 7), which is situated between two parallel ridges 9.

Figure 9:
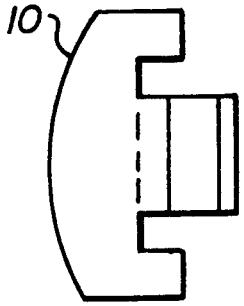
FIG. 9 is an end view of the pad.
Figure 8:
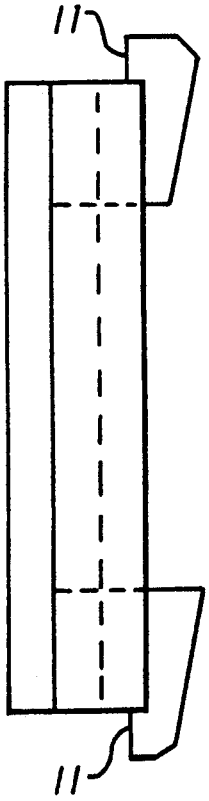
FIG. 8 is a side view of one of the pads of the stabilizer.
Figure 10:
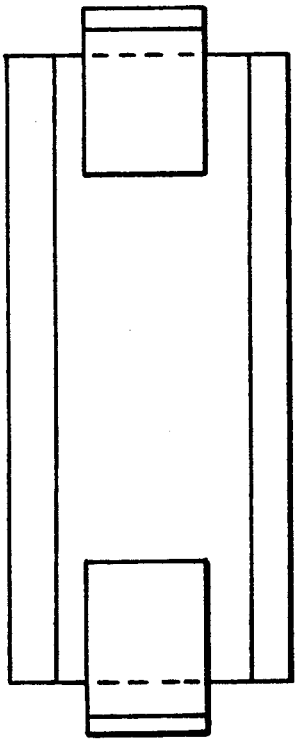
FIG. 10 is a view of the underside of the pad.

Each track 7 forms a camming surface, which is engaged by the underside of a pad 10. As can be seen in FIGS. 8 to 10, the shape of the underside of the pad 10 at its end regions complements the shape of the track 7.

The number of tracks present on the mandrel 2 is, therefore, the same as the number of pads 10 present on the stabilizer. The stabilizer shown in FIGS. 1 to 3 has two pairs of pads 10, one pair being situated slightly above the other, and the four pads being situated at 90' intervals around the casing 1.

Figure 6:
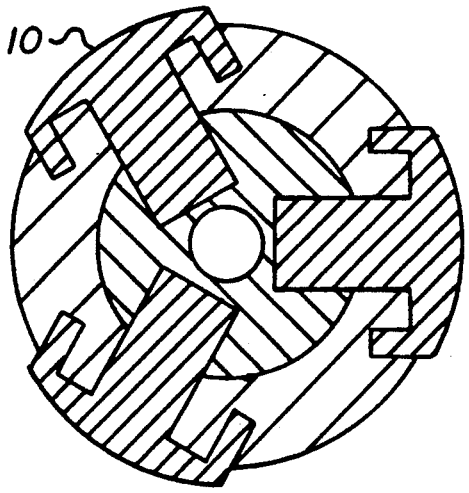
FIG. 6 is a sectional view of the pads mounted on the casing and mandrel of a three-pad version of the stabilizer.

Alternatively, three pads 10 can be used, in which case the pads are situated at the same height, and at 120' intervals around, the casing 1 (FIG. 6).

Each pad 10 is located in a hole in the casing 1, and has a retaining surface 11 incorporated into each end. Each surface 11 engages the inner end of a compression spring 12. The opposite end of the spring 12 bears against a pad retaining member 13.

The relative positions of the surfaces 11, the retainer members 13 and the periphery of the hole in the casing 1 are such that each pad 10 is constrained to move only in a radial direction (relative to the casing 1) when the mandrel 2 slides along the casing 1, and that each pad 10 is biased into a retracted position by the combined actions of its associated springs 12 and retaining members 13.

The upper end of the mandrel 2 has a region of reduced outer radius which, together with the inner walls of the casing 1, defines an annular actuation chamber 14.

The actuation chamber 14 houses three pairs of dogs 15, which are pivotally mounted with respect to the mandrel 2 at varying heights.

Figure 4:
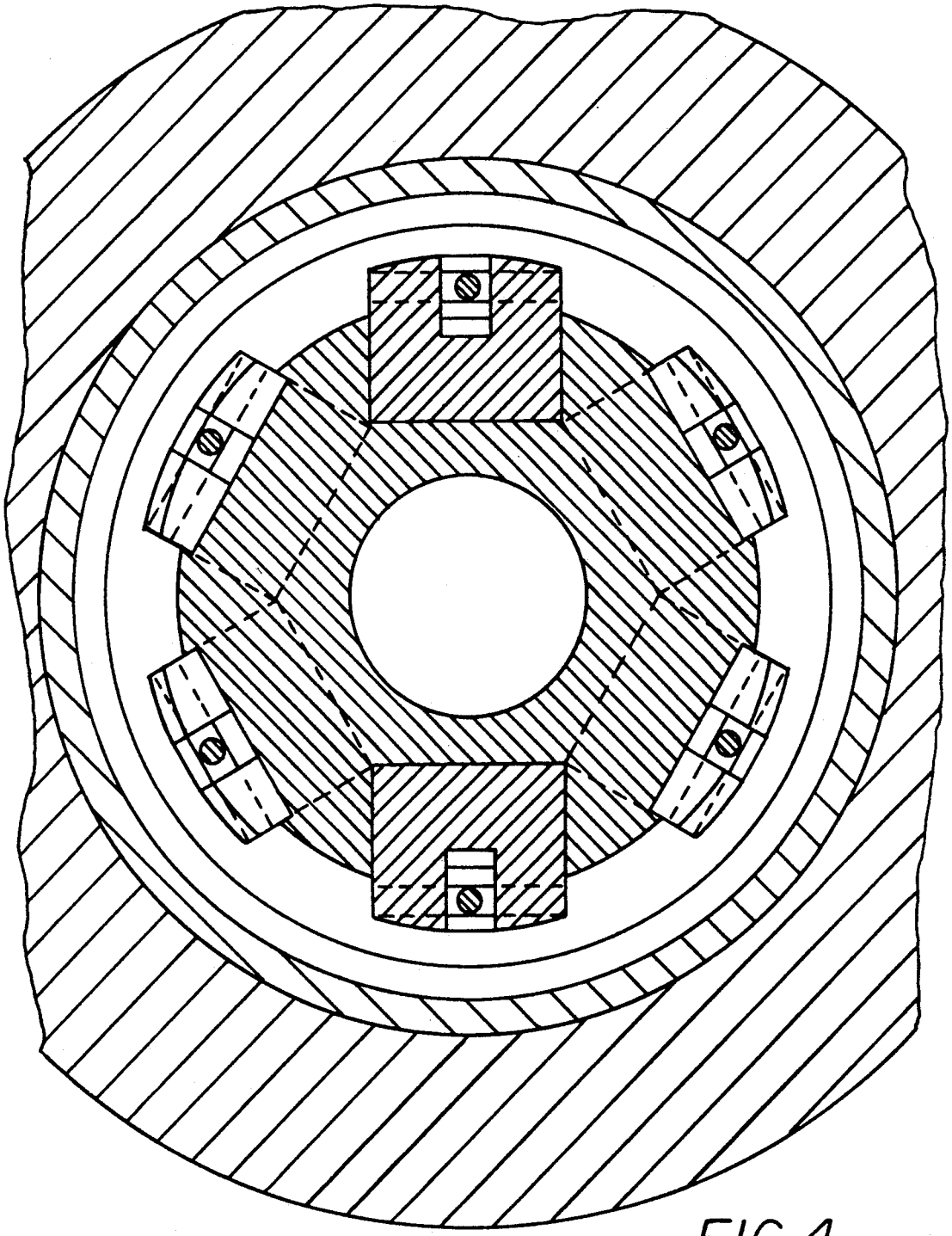
FIG. 4 is a sectional view along the line C—C on FIG. 2.
Figure 5:
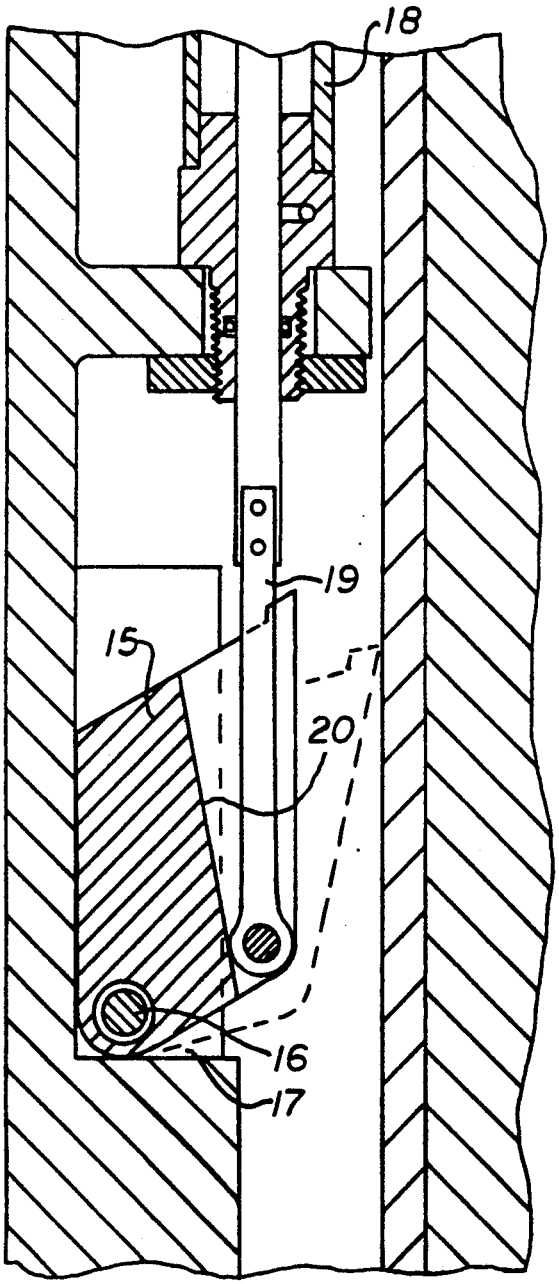
FIG. 5 is an expanded view of a part of the stabilizer shown in FIG. 2.

FIG. 5 shows one of these dogs, which is pivotally mounted in a recess (shown in FIG. 4), via a pivot pin 16. Referring to FIG. 4, the six dogs 15 are mounted at 60' intervals about the mandrel 2.

Each dog 15 is connected to a pneumatic actuation cylinder 18 via a connecting rod 19. Each connecting rod 19 is pivotted at its lower end to its corresponding dog 15 in a groove 20 in the outer face of the dog 15. The groove 20 is so inclined that, when the cylinder 18 is operated to vertically raise or lower the connecting rod 19, the corresponding dog 15 pivots between the position shown in solid and broken lines in FIG. 5.

The canister 14 also contains an annular mandrel stop 21 which, in use, engages an extended pair of dogs to prevent upward movement of the mandrel 2.

Each pneumatic cylinder 18 is powered by a compressed air source 22, and is controlled by a set of solenoid valves (not shown). The solenoid valves are, in turn, controlled by a digital computer 23.

The computer 23 is also connected to a sensor switch 24 which is so arranged as to provide a binary 1 (or on) signal when the switch 24 is closed, and a binary 0 (or off) signal when the switch 24 is open.

Figure 11:
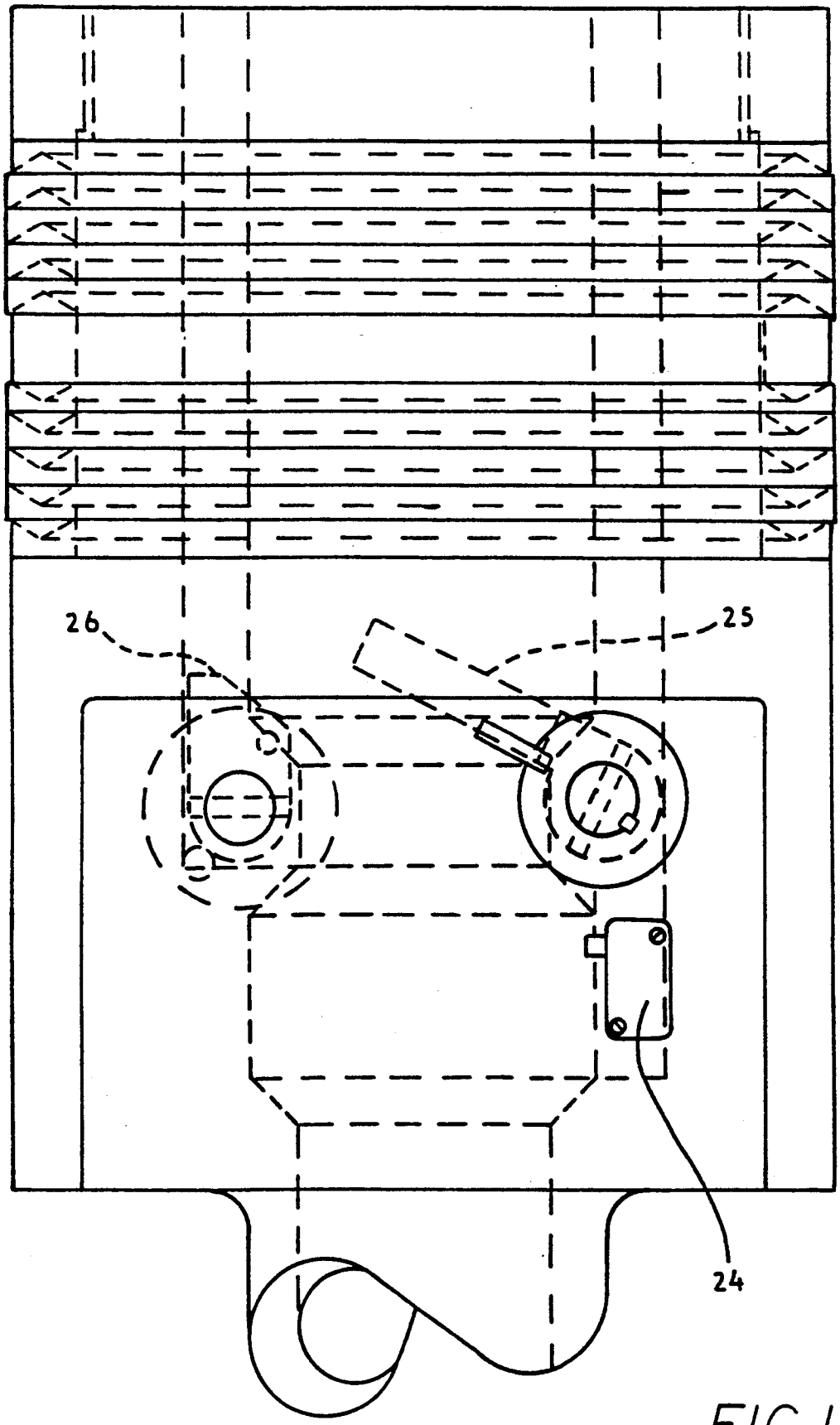
FIG. 11 is a detailed view of part of the stabilizer shown in FIG. 1.

The switch 24 is situated next to the central bore (or conduit) of the mandrel 2, and just downstream of a paddle 25. The paddle 25 is pivotally mounted in a recess in the mandrel bore, and with no fluid flow down the mandrel, is spring-biased into the position shown in FIG. 11. The paddle 25 is so sized and shaped that, when in a horizontal position, it fits closely within the mandrel bore, but that it is capable of pivoting beneath the horizontal until its underside bears against, and thus closes, the switch 24. A sufficiently rapid flow of drilling fluid through the mandrel will thus result in the switch 24 providing the computer 23 with a binary 1 signal.

Figure 12:
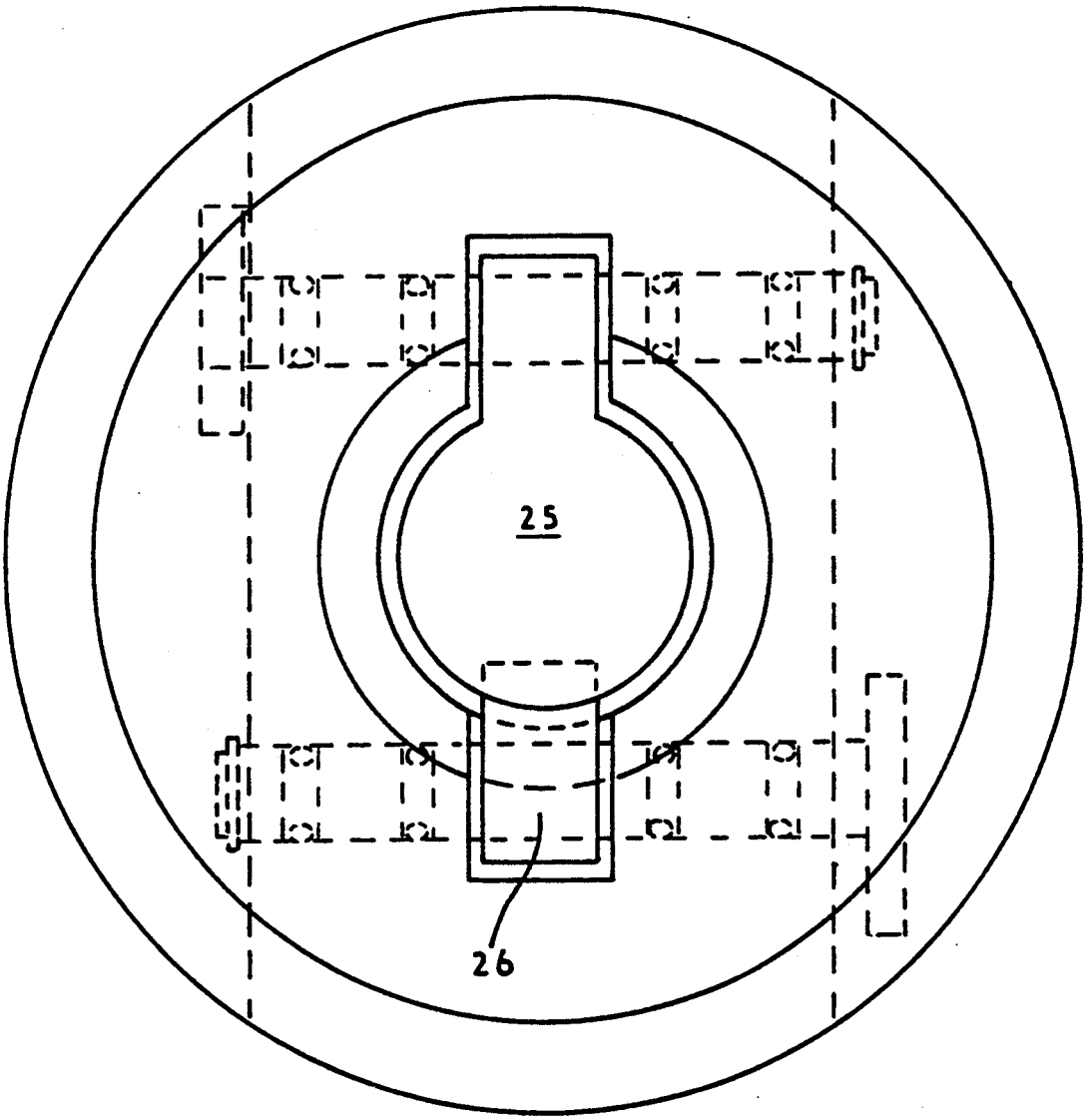
FIG. 12 is an end view of the component shown in FIG. 11.
Figure 13:
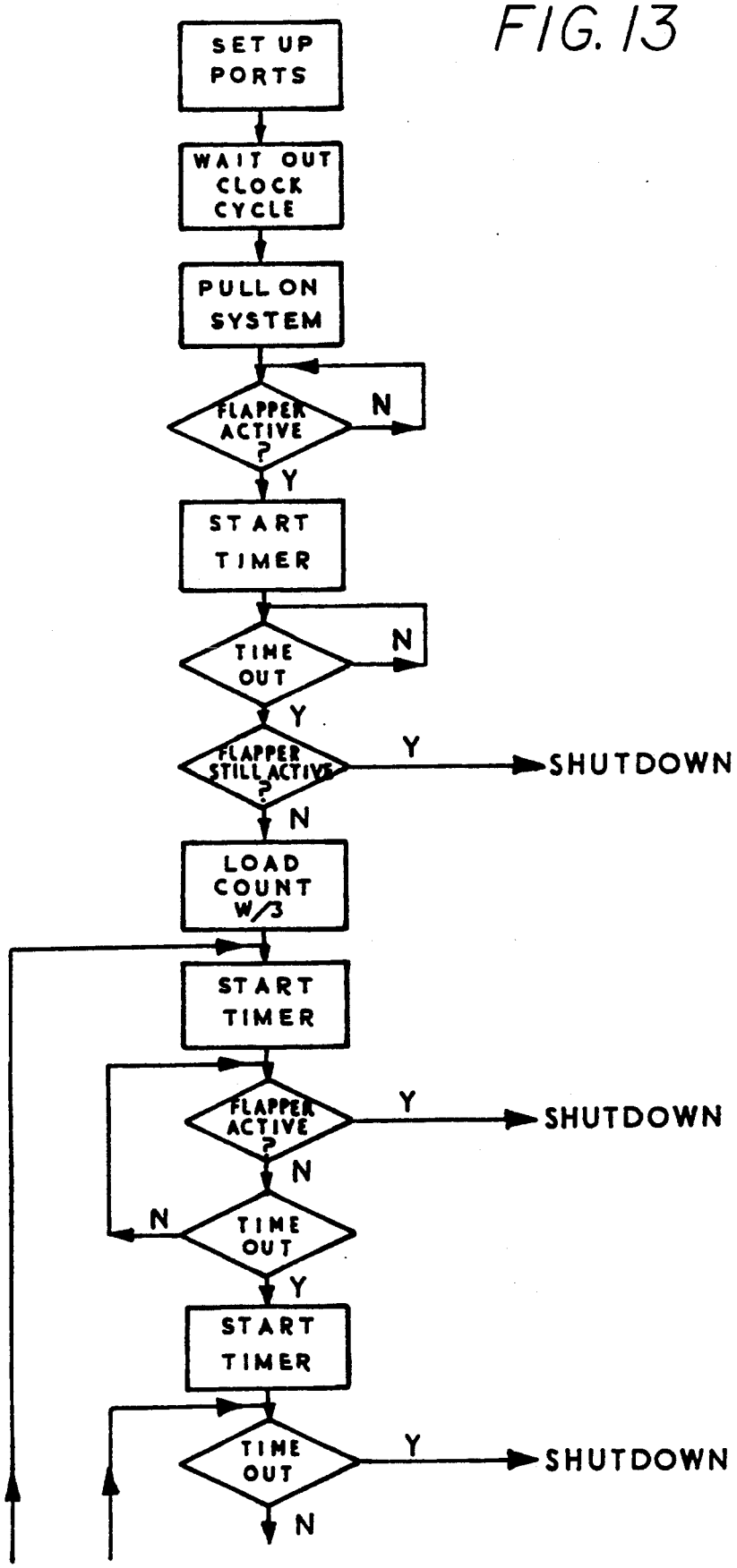
FIGS. 13 to 18 show the flow chart of the program used by the computer which controls the stabilizer.
Figure 14:
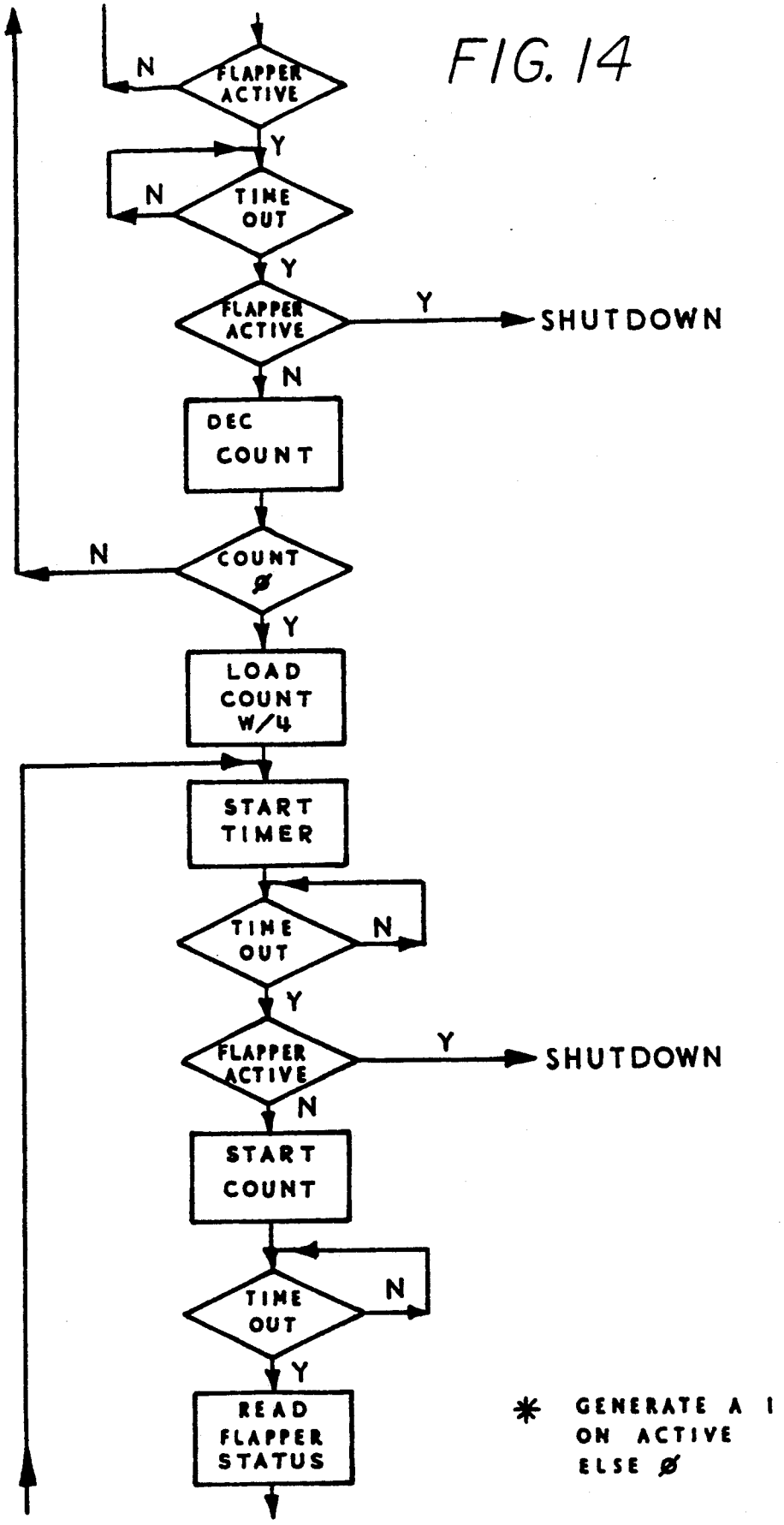
Figure 15:
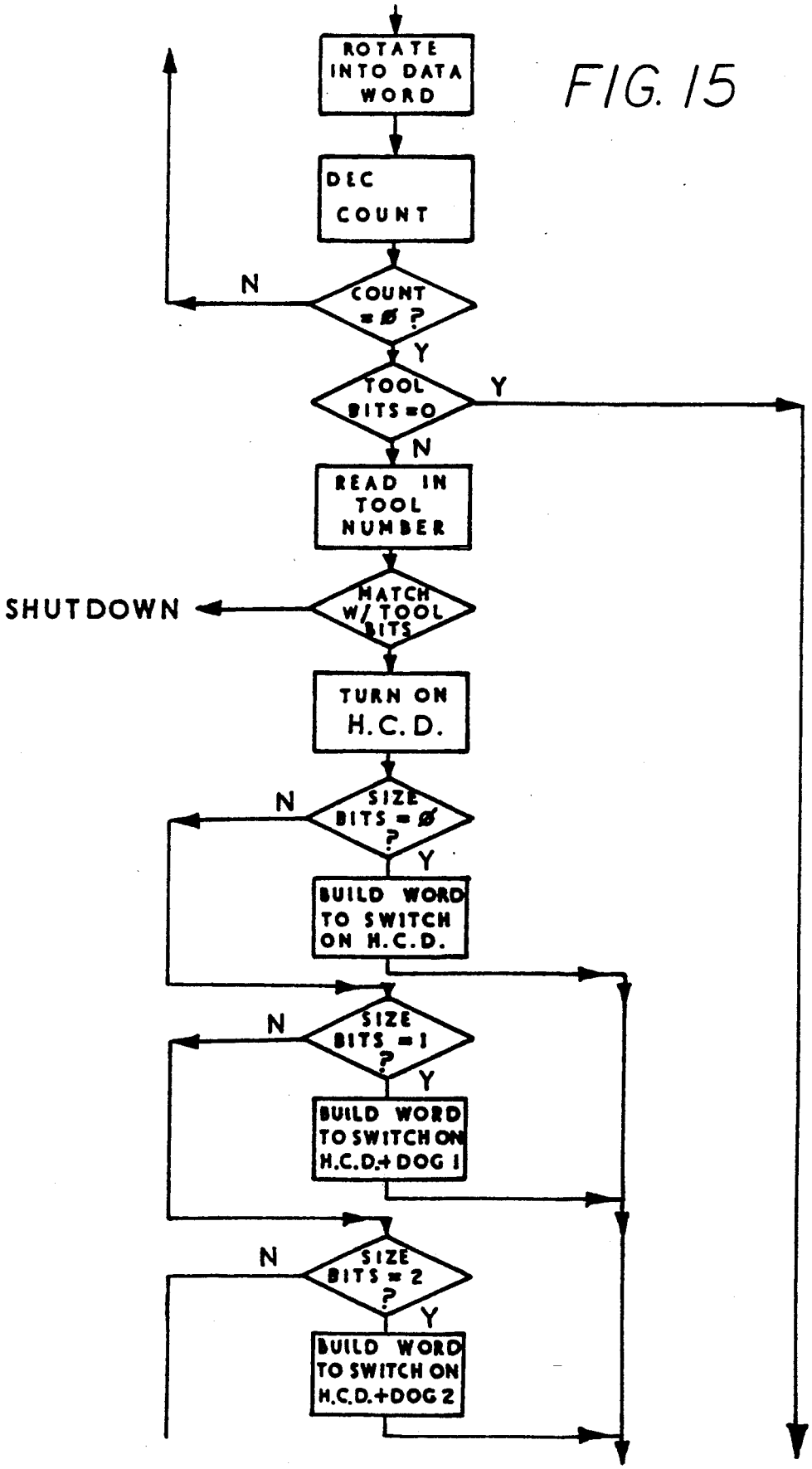
Figure 16:
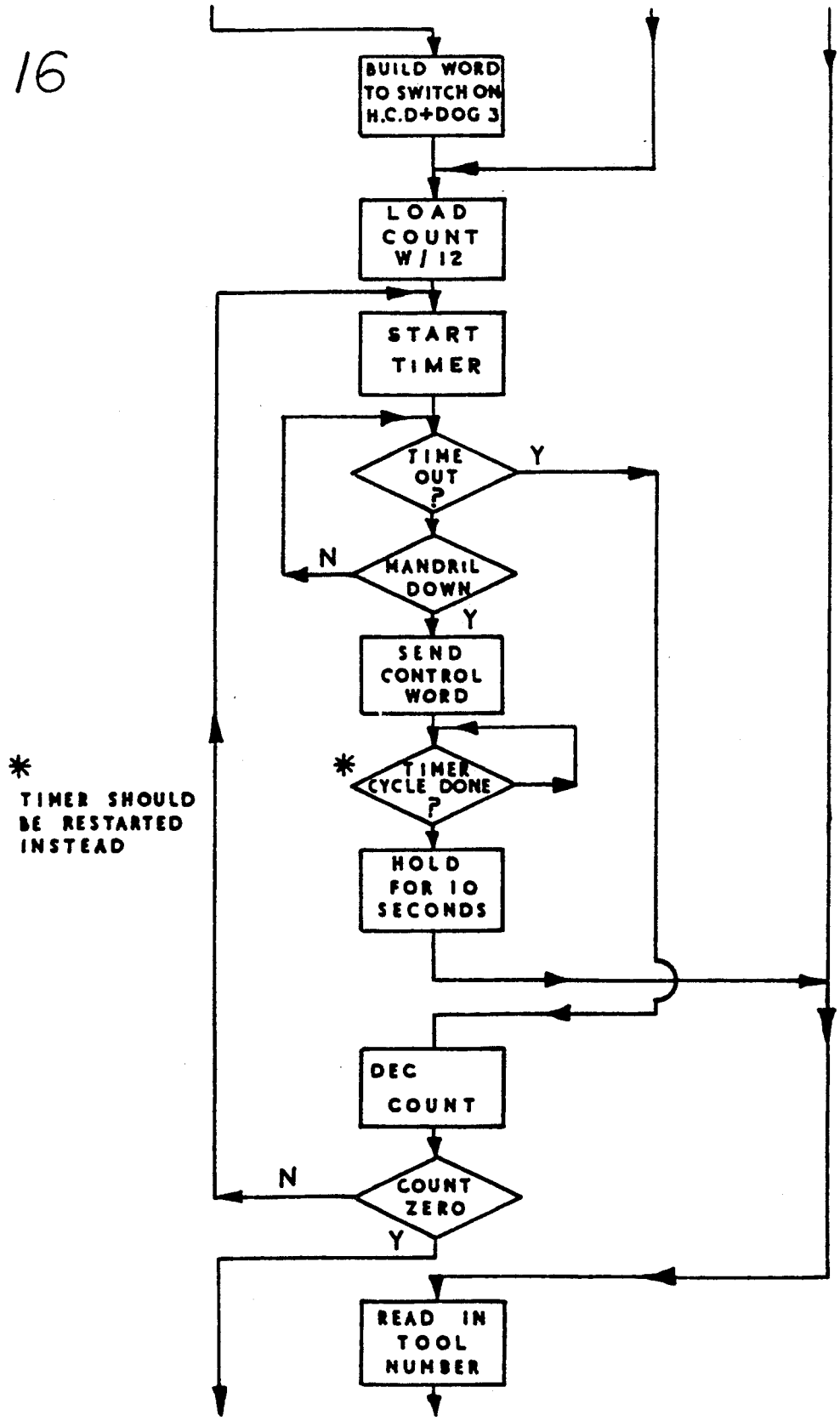
Figure 17:
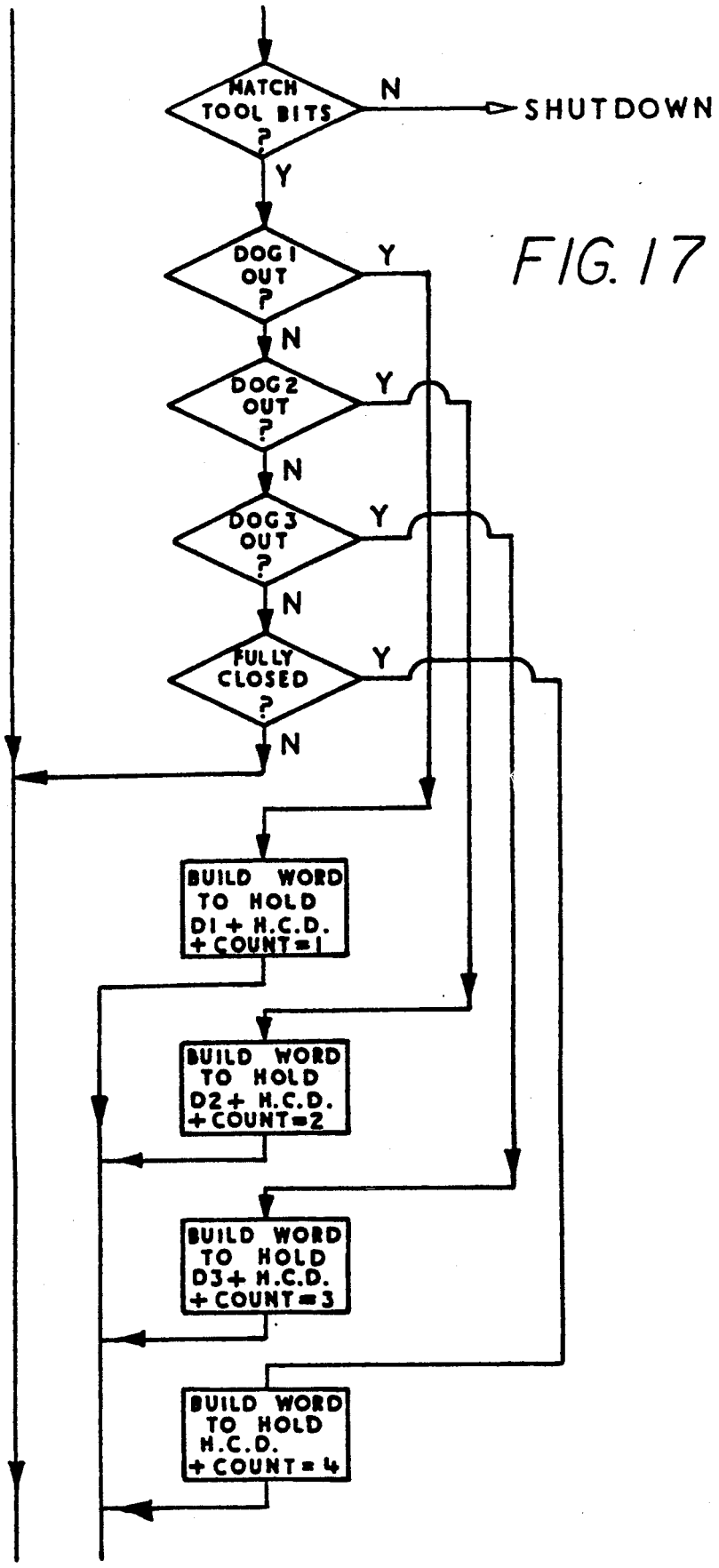
Figure 18:
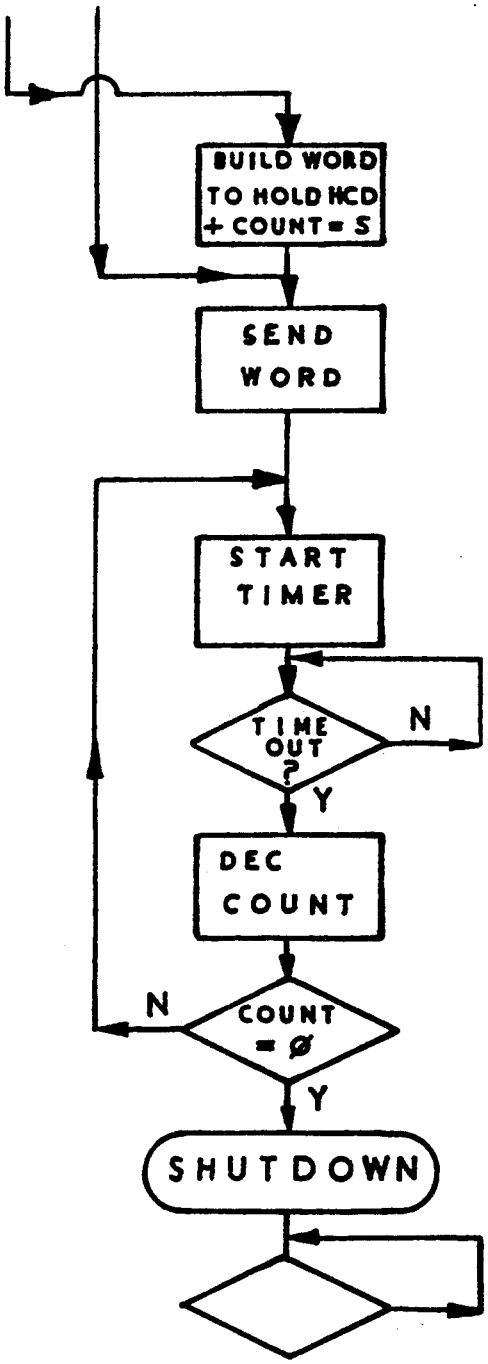
Figures 19A, 19B:
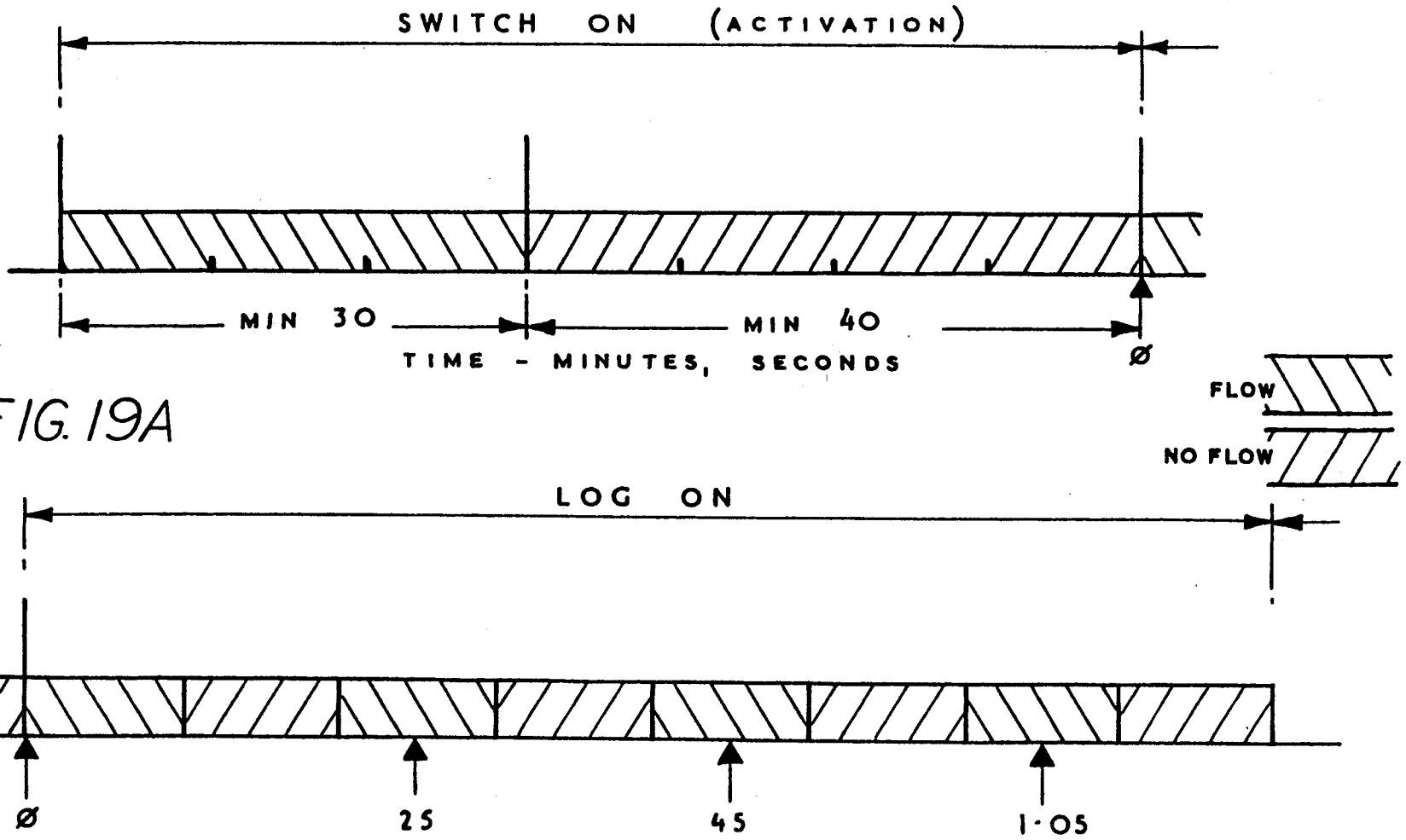
FIGS. 19A-19E comprise a data input schematic.
Figure 19C:
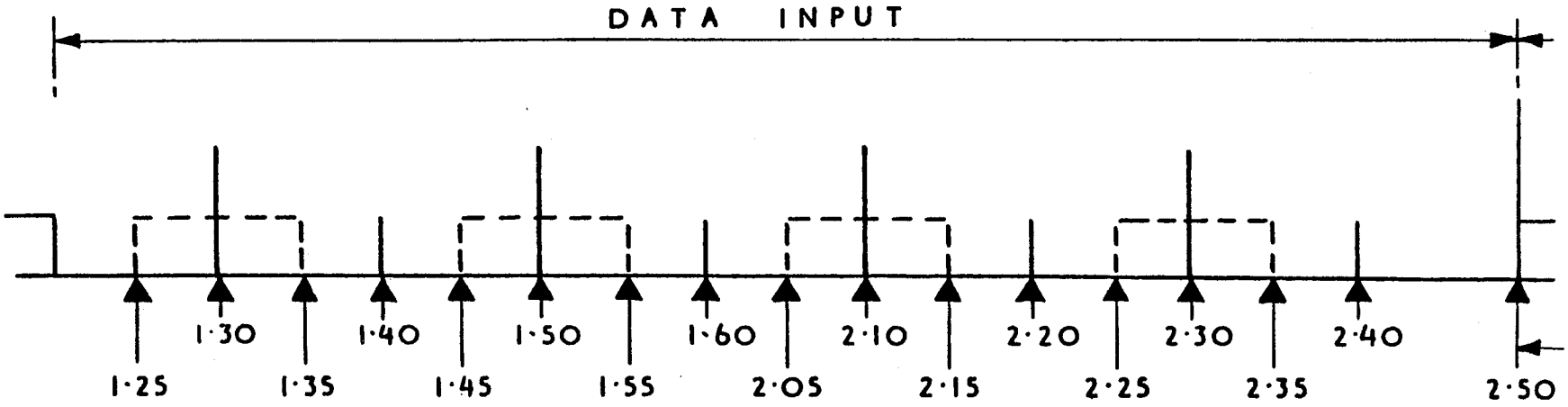
Figure 19D:
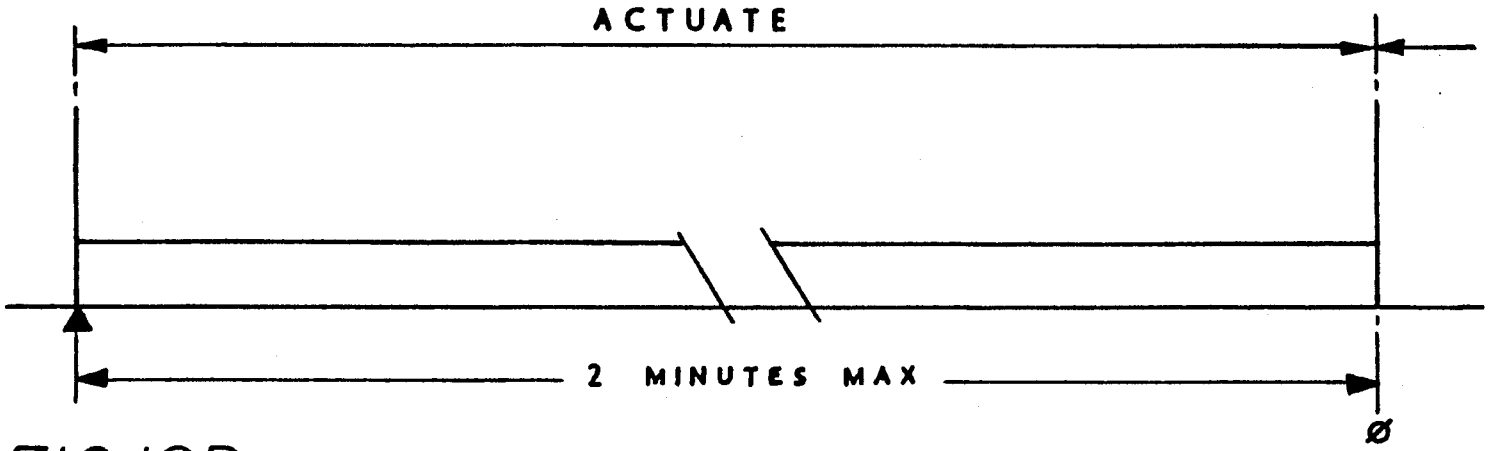
Figure 19E:
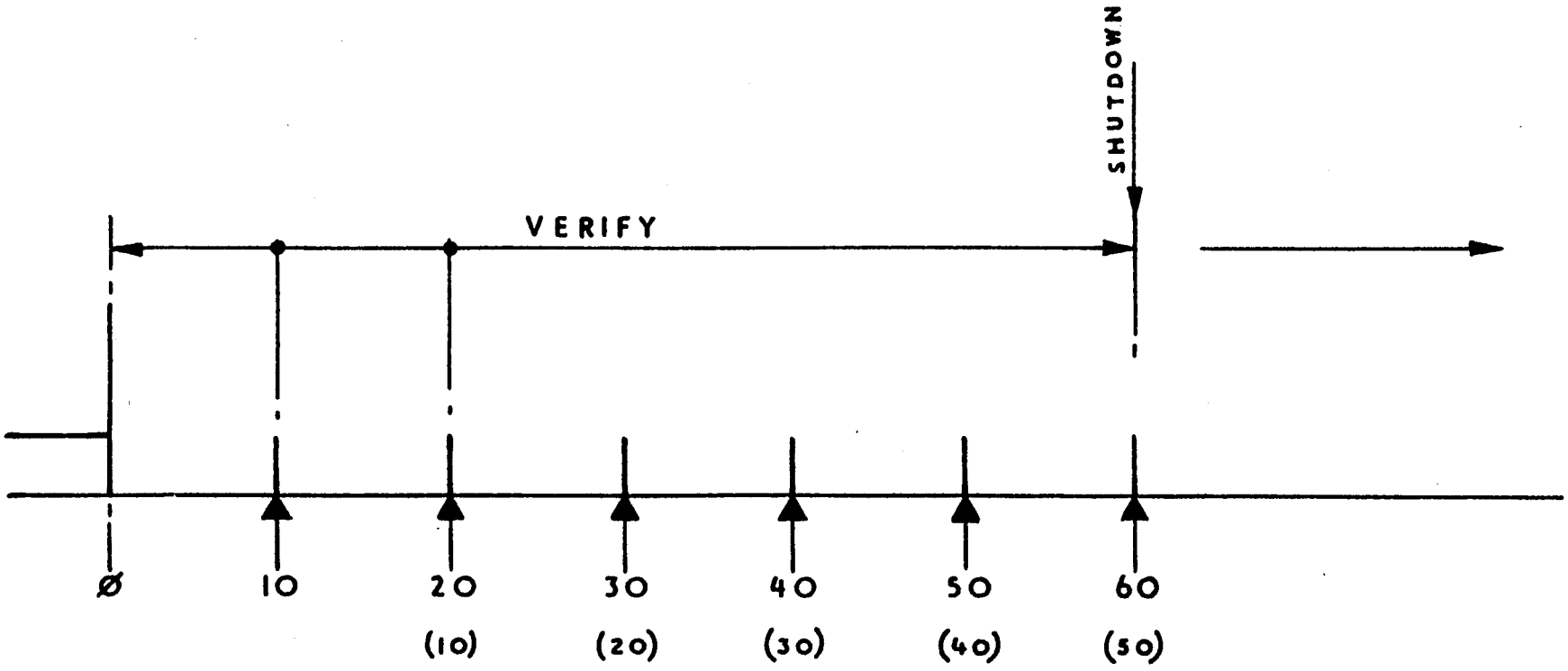

A pneumatically actuated paddle stop 26 is pivotally mounted in the bore of the mandrel 2, and opposite the paddle 25. The paddle stop 26 is controlled by the computer 23, and may be pivoted between a retracted position (FIG. 11), and a protruding position (FIG. 12). When the paddle stop 26 is in its retracted position, it does not interfere with the movement of the paddle 25, but when it is extended into the protruding position, the paddle stop 26 prevents the paddle 25 from pivoting below the horizontal. The bore of the mandrel 2 can thus be sealed by pivoting the paddle stop 26 into a protruding position beneath the paddle 25, and causing the drilling fluid to exert a downward force on the paddle 25 to force it against the paddle stop 26.

The computer 23 is also connected to a second microswitch (not shown), which is so mounted on or near the shoulder 3 a to be closed by the mandrel 2 when it reaches the limit of its downward movement. The diagram entitled MONITORING SEQUENCE forms part of this specification, and illustrates one way in which the computer 23 can compare the output of the switch 24, and thus the variations in the fluid flow through the drill string, with the predetermined sequences corresponding to instructions for the stabilizer.

The monitoring sequence is divided into a number of phases; activation; log on; data input; and, after an actuation period during which the transmitted instructions are executed, verification.

The purpose of the activation phase is to initiate the monitoring sequence, and to ensure that the computer is at the beginning of the log on phase. The output of the switch 24 is initially monitored by a low power circuit, which activates the computer if no fluid flow is detected (i.e. the switch 24 remains open) for a period of thirty seconds. On activation, the computer monitors the output of the switch 24 for a first period of ten seconds; if fluid flow is detected during this first period, then the computer will shut down, activating the low power circuit. The computer will also do this if fluid flow is detected for more than twenty seconds. The activation phase, therefore, consists of an initial thirty-second period of fluid flow, which ensures that the computer is shut down, followed by a no-flow period of forty seconds, which causes the low power circuit to activate the computer and the computer to initiate the log on phase. The sequence of fluid flow variations conforming with the activation phase may have been generated during, for example, the addition of a section to the top of the drill string, and not for the purposes of instructing the stabilizer.

The computer, therefore, uses the log on phase to determine whether or not the stabilizer is being instructed. The log on phase consists of alternating ten second periods of "flow" and "no flow". As can be seen from the diagram, the first period is a "flow" period.

During each of the "flow" periods, fluid flow must be detected at least once, whilst no fluid flow must be detected during any of the "no flow" periods. If, for example, no fluid flow is detected in the first period, or fluid flow is detected during the second period, the computer will shut down. In this way the computer distinguishes between a transmitted set of instructions, and random fluctuations in the fluid flow.

Although the diagram shows a log on phase having eight periods, more or less periods may be used depending on the extent of the random fluctuations of the fluid flow. If the fluid flow conforms to the log on sequence, the computer enters into the data input phase.

During the data input phase, the computer periodically samples the state of the switch 24 at predetermined points in time. As can be seen from the diagram, there is a series of alternating "flow" and "no flow" sampling points. If flow is detected at a "no flow" sampling point (e.g. 1.40), then the computer will shut down. However, if no flow is detected at a "flow" sampling point, the computer will store that result as a binary 0, whilst any flow detected at a "flow" sampling point will be recorded as a binary 1. On completion of the data input phase the computer will, therefore, have generated a binary number.

This binary number represents the instructions which have been sent to the stabilizer. The data input phase shown in the diagram enables a four-digit binary number to be transmitted, but larger numbers can be sent if the data input phase is lengthened.

The instructions represented by the binary signal are executed during the actuation period. If, for example, the instructions were to fully extend the pads, then the following sequence of events would occur:

Firstly, the computer will move the paddle stop 26 into its protruding position. Since this happens at the end of the data input phase, there is no fluid flow and the paddle 25 is consequently in the position shown in FIG. 11. When fluid begins to flow down the drill string, the paddle 25 will bear against the stop 26, sealing the mandrel 2. As the pressure exerted by the fluid above the mandrel 2 increases, the mandrel 2 is forced down against the action of the spring 4, causing the pads 10 to extend. This continues until the second sensor switch is closed.

The computer than extends the highest pair of dogs, fluid pressure is then removed, causing the mandrel to move back up the casing 1 until the highest dogs engage the mandrel stop 21.

If the second sensor switch is not closed at the end of the actuation phase, the computer will ignore the instructions, and transmit an error signal in the verification phase.

During the verification phase, the computer maintains the paddle stop 26 in a protruding position for a time distinctive of the status of the stabilizer. Thus, by measuring the pressure of the drilling fluid at certain intervals of time, the operator can obtain confirmation that the transmitted instructions have been executed. An example of the range of delays is ten seconds if the upper pair of dogs are extended, twenty seconds if the middle pair are extended, thirty seconds if the lower pair are extended, forty seconds if none of the dogs are extended and a sixty second error signal.

It is also possible to instruct the stabilizer to "report" its current "status" by passing straight into the verification phase, without extending or retracting any of the dogs.

This delay period can be ascertained by periodically applying and measuring fluid pressure in the drill string. When a reduced pressure is measured, the operator knows that the paddle stop 26 is in its retracted position. It will be appreciated that the paddle stop 26 cannot be retracted when fluid pressure is being applied.

Instead of a paddle 25, a paddle wheel may be used As an alternative to the pneumatic cylinders 18, and the pneumatic actuation means for the paddle stop 26, sets of Servo motors may be used.

In this case, the paddle stop 26 is linked to the drive shaft of such a motor, whilst the motors for the dogs 15 impart linear movement to the connecting rods 19 via a rack-and-pinion system.

It will be appreciated that the motors acting in combination with their associated power sources act as electronic actuators.

FIG. 21 shows a variation of the drill string stabilizer shown in FIGS. 1, 2 and 3, the portions shown in FIGS. 2 and 3 being essentially unchanged, but the uppermost portion having a different data exchange arrangement The lowermost part of FIG. 21 corresponds to upper end of the mandrel 2 in FIG. 1, just above the compressed air source 22 and the computer 23. A mandrel extension 30 has a reduced diameter so as to leave an annular bypass chamber 31 therearound. The bypass chamber 31 is connected at its lower end with the through chamber of the mandrel via a plurality of vents 32 therethrough. At the upper end, the mandrel extension 30 has a top portion 33 which engages the inner wall of the outer casing 1 and which has a plurality of vents 34 permitting fluid communication between the bypass chamber 31 and the upper part of the bore of the casing 1, as hereinafter described A piston 35 is slidably mounted in the upper part of the mandrel extension 30 and has a head portion 36 which slides across the vents 34 partially or fully opening them to flow, depending on the position of the piston A helical compression spring 37 serves to urge the piston upwardly The spring 37 is seated in a cup 38 located between a pivoted pair of dogs 39. The dogs 39 are acted upon by a push rod 40 via a helical spring 41. The action of the cup 38 on the dogs 39 is to urge the dogs to an inner position as shown in FIG. 21, wherein they serve as a stop limiting downward travel of the piston so that it partially obscures the vents 34. The push rod 40, driven by an electric servo motor 42 to move the push rod 40 upwardly urges the dogs 39 outwardly, releasing the piston 35 to travel a further distance downwards, opening the vents 34 fully and causing a drop in the drilling fluid pressure detected at the surface. Signaling to the surface can thus be carried out by allowing the piston to move between these two positions in a timed sequence.

To receive information, fluid flow may be detected by a sensor directly at the piston or sensor mounted so as to detect the movement of the entire device against a spring, as would occur due to the inherent resistance of the entire device to the fluid. The sensor may conveniently comprise a switch (not shown) actuated by the piston 35 as it travels downwards due to an increase in fluid pressure sent from the surface and released when the piston 35 travels upwards due to a decrease in fluid pressure In the partially restricted position of the vents 34, the pressure is sufficient to drive mandrel 2 downwards as hereinbefore described with reference to FIGS. 1, 2 and 3 to cause the pads to move outwardly to hold the stabilizer in position.

We claim:

1. A method of receiving instructions for an implement having a flow passage therethrough, for example, a drill string stabilizer, mounted on a drill string, which instructions are transmitted by varying the rate of flow of, or pressure exerted by, the fluid in the bore of the drill string and said flow passage in accordance with one of a plurality of predetermined sequences; the method comprising the steps of:

(a) monitoring variations in the rate of flow of or pressure exerted by the fluid in the drill string;

(b) comparing the sequence of monitored variations with a plurality of predetermined sequences, each predetermined sequence corresponding to a set of instructions for the implement, and (c) ignoring the variations if they do not correspond to a predetermined sequence.

2. A method of receiving instructions for an implement having a flow passage therethrough, for example, a drill string stabilizer, mounted on a drill string, which instruction are transmitted by varying the rate of flow of, or pressure exerted by, the fluid in the bore of the drill string and said flow passage in accordance with one of a plurality of predetermined sequences; the method comprising the steps of:

(a) monitoring variations in the rate of flow of or pressure exerted by the fluid in the drill string;

(b) comparing the sequence of monitored variations with a plurality of predetermined sequences, each predetermined sequence corresponding to a set of instructions for the implement, and (c) if the sequences do correspond to a predetermined sequence, executing the instructions which correspond to that sequence.

3. A method of receiving instructions for an implement, for example, a drill string stabilizer, mounted on a drill string, in which the implement includes a conduit through which drilling fluid may flow and means which, when activated, so seal the implement as to restrict or prevent the flow of drilling fluid through the implement, which instructions are transmitted by varying the rate of flow of, or pressure exerted by, the fluid in the bore of the drill string in accordance with one of a plurality of predetermined sequences; the method comprising the steps of:

(a) monitoring variations in the rate of flow of or pressure exerted by the fluid in the drill string;

(b) comparing the sequence of monitored variations with a plurality of predetermined sequences, each predetermined sequence corresponding to a set of instructions for the implement, and (c) ignoring the variations if they do not correspond to a predetermined sequence.

4. A method of receiving instructions for an implement, for example, a drill string stabilizer, mounted on a drill string, in which the implement includes a conduit through which drilling fluid may flow and means which, when activated, so seal the implement as to restrict or prevent the flow of drilling fluid through the implement, which instructions are transmitted by varying the rate of flow of, or pressure exerted by, the fluid in the bore of the drill string in accordance with one of a plurality of predetermined sequences; the method comprising the steps of:

(a) monitoring variations in the rate of flow of or pressure exerted by the fluid in the drill string;

(b) comparing the sequence of monitored variations with a plurality of predetermined sequences, each predetermined sequence corresponding to a set of instructions for the implement, and (c) if the sequences do correspond to a predetermined sequence, executing the instructions which correspond to that sequence.

5. A method according to claim 3, in which each set of instructions for the implement includes the step of maintaining the sealing means in an activated condition for a period of time distinctive of those instructions or of the status of the implement.

6. A method according to claim 4, in which each set of instructions for the implement includes the step of maintaining the sealing means in an activated condition for a period of time distinctive of those instructions or of the status of the implement.

7. A drill string stabilizer comprising a mandrel, slideably mounted within an outer casing; one or more pads movable between a retracted position and one or more extended positions; means monitoring the rate of flow of or pressure exerted by the fluid in the drill string, in use; and means which, when activated, seal the stabilizer to restrict or prevent the flow of fluid through it; the arrangement being such that, with the sealing means activated, the exertion of a predetermined amount of pressure by the fluid causes the mandrel to slide within the casing, and the pad or pads to consequently extend.

8. A stabilizer according to claim 7 including means maintaining the pad or pads in one of a plurality of extended positions; the maintaining means comprising a set of dogs; each of which is pivotally mounted on the mandrel or the casing at a position corresponding to one of the extended pad positions; and means to extend each dog, in use, in response to a selected instruction, to so engage a surface of the casing or mandrel as to prevent the sliding of the mandrel in at least one direction along the casing.

9. Apparatus for receiving instructions for an implement having a flow passage therethrough, for example, a drill string stabilizer, mounted on a drill string, which instructions are transmitted by varying the rate of flow of, or pressure exerted by, the fluid in the bore of the drill string and said flow passage in accordance with one of a plurality of predetermined sequences; the apparatus comprising (a) means monitoring variations in the rate of flow of or pressure exerted by the fluid in the drill string; and (b) means comparing the monitored variations with a plurality of predetermined sequences, each predetermined sequence corresponding to a set of instructions for the implement, which comparing means ignore the monitored variations if they do not correspond to a predetermined sequence.

10. Apparatus for receiving instructions for an implement having a flow passage therethrough, for example, a drill string stabilizer, mounted on a drill string, which instructions are transmitted by varying the rate of flow of, or pressure exerted by, the fluid in the bore of the drill string and said flow passage in accordance with one of a plurality of predetermined sequences; the apparatus comprising (a) means monitoring variations in the rate of flow of or pressure exerted by the fluid in the drill string; and (b) means comparing the monitored variations with a plurality of predetermined sequences, each predetermined sequence corresponding to a set of instructions for the implement, which comparing means execute the instructions which correspond to that sequence if the monitored variations do correspond to a predetermined sequence.

11. Apparatus for receiving instructions for an implement, for example, a drill string stabilizer, mounted on a drill string, which instructions are transmitted by varying the rate of flow of, or pressure exerted by, the fluid in the bore of the drill string in accordance with one of a plurality of predetermined sequences; the apparatus comprising (a) means comprising a paddle, pivotally mounted on the implement monitoring variations in the rate of flow of or pressure exerted by the fluid in the drill string; and (b) means comparing the monitored variations with a plurality of predetermined sequences, each predetermined sequence corresponding to a set of instructions for the implement, which comparing means ignore the monitored variations if they do not correspond to a predetermined sequence.

12. Apparatus for receiving instructions for an implement, for example, a drill string stabilizer, mounted on a drill string, which instructions are transmitted by varying the rate of flow of, or pressure exerted by, the fluid in the bore of the drill string in accordance with one of a plurality of predetermined sequences; the apparatus comprising (a) means comprising a paddle, pivotally mounted on the implement monitoring variations in the rate of flow of or pressure exerted by the fluid in the drill string; and (b) means comparing the monitored variations with a plurality of predetermined sequences, each predetermined sequence corresponding to a set of instructions for the implement, which comparing means execute the instructions which correspond to that sequence if the monitored variations do correspond to a predetermined sequence.

13. Apparatus according to claim 11 and including sealing means which, when activated, so seal the implement as to restrict or prevent the flow of drilling fluid through the implement.

14. Apparatus according to claim 12 and including sealing means which, when activated, so seal the implement as to restrict or prevent the flow of drilling fluid through the implement.

15. Apparatus according to claim 13 in which the sealing means comprise the paddle and a paddle stop, which is movable between a retracted and a protruding position; and means to activate the sealing means by moving the paddle stop into its protruding position.

16. Apparatus according to claim 14 in which the sealing means comprise the paddle and a paddle stop, which is movable between a retracted and a protruding position; and means to activate the sealing means by moving the paddle stop into its protruding position.

17. Apparatus according to claim 9, in which the monitoring means comprise a piston in conjunction with a spring and with means so positioning the piston to relation to the spring that the piston is movable by pressure exerted by the fluid in the drill string against the force of the spring.

18. Apparatus according to claim 10, in which the monitoring means comprise a piston in conjunction with a spring and with means so positioning the piston in relation to the spring that the piston is movable by pressure exerted by the fluid in the drill string against the force of the spring.

19. Apparatus according to claim 17, wherein the said means so position the piston that the piston is movable between a first position, wherein flow of drilling fluid through the implement is restricted and a second position, wherein the piston offers no restriction to the flow of drilling fluid through the implement.

20. Apparatus according to claim 18 wherein the said means so position the piston that the piston is movable between a first position, wherein flow of drilling fluid through the implement is restricted and a second position, wherein the piston offers no restriction to the flow of drilling fluid through the implement.

* * * * *